US006085678A

United States Patent [19]

Würzburg

[11] Patent Number: 6,085,678

[45] Date of Patent: Jul. 11, 2000

[54] WATER VEHICLE

[76] Inventor: Hanno Würzburg, Eichener Höhe, 41063 Mönchengladbach, Germany

[21] Appl. No.: 09/269,868

[22] PCT Filed: Oct. 6, 1997

[86] PCT No.: PCT/DE97/02281

§ 371 Date: Apr. 20, 1999

§ 102(e) Date: Apr. 20, 1999

[87] PCT Pub. No.: WO98/15451

PCT Pub. Date: Apr. 16, 1998

[30] Foreign Application Priority Data

Oct. 5, 1996 [DE] Germany ..... 196 41 146

[51] Int. Cl.[7] ..... B63B 1/00

[52] U.S. Cl. ..... 114/61.1; 114/61.25; 114/61.2; 114/61.24

[58] Field of Search ..... 114/39.12, 39.14, 114/39.21, 39.25, 39.26, 39.28, 61.1, 61.24, 61.2, 61.15, 283, 292

[56] References Cited

U.S. PATENT DOCUMENTS

| | | | |
|---|---|---|---|
| 3,273,528 | 9/1966 | Kiefer | 114/61.24 |
| 3,841,251 | 10/1974 | Larson | 114/39.28 |
| 4,401,047 | 8/1983 | Auras | 114/39.25 |
| 4,662,297 | 5/1987 | Crowley et al. | 114/39.26 |
| 5,024,177 | 6/1991 | Winter et al. | 114/39.26 |

FOREIGN PATENT DOCUMENTS

| | | |
|---|---|---|
| 903 630 | 3/1986 | Belgium . |
| 0 012 288 | 6/1980 | European Pat. Off. . |
| 0 152 306 | 8/1985 | European Pat. Off. . |
| 81 16 675 | 10/1981 | Germany . |
| 31 45 595 | 5/1983 | Germany . |
| 33 44 543 | 9/1985 | Germany . |
| 37 30 042 | 2/1988 | Germany . |

*Primary Examiner*—Stephen Avila
*Attorney, Agent, or Firm*—Henry M. Feiereisen

[57] ABSTRACT

The water vehicle has two parallel surfboards arranged with a distance between them, connected to one another with the help of a frame. The two legs of the frame arranged in the direction of travel have flexible elements, and the frame forms a diagonally braced rectangle.

The flexible elements and the diagonal bracing greatly improve the maneuverability of the water vehicle. This is true especially at high speeds and strong forces acting on the surfboards.

11 Claims, 11 Drawing Sheets

WATER VEHICLE

BACKGROUND OF THE INVENTION

This invention concerns a water vehicle with two surfboards arranged in parallel with a distance between them, connected to one another with the help of a frame.

Such a water vehicle is known from German Patent No. 4,030,225 and German Patent No. 4,243,752.

However, the water vehicles described there have the disadvantage that they easily become unstable at high speeds, which has a negative effect on driving performance while, on the other hand, leading to extreme stresses on the frame.

Therefore, the object of the present invention is to further develop a generic water vehicle so that it will have good driving properties even at high speeds.

This object is achieved by the fact that with a generic water vehicle, the frame has a main frame and a connecting rod, each connected to the surfboards and legs arranged in the direction of travel, with the two legs of the frame arranged in the direction of travel having flexible elements, and the frame forms a diagonally braced rectangle.

The frame constructed in this way converts the forces of the waves acting on partial areas of the frame, which results in a lower resistance and thus a higher final velocity.

SUMMARY OF THE INVENTION

Surf gliders known in the past have had rigid frame legs arranged in the direction of travel and have led to rocking of the water vehicle at high speeds. In contrast with this, the frame according to this invention can be designed so that it accommodates with static rigidity only the rear foot loops of the surfboards plus optionally an outboard motor. Then elements that are flexible at the front are attached to the rear frame part, dynamically connecting the main frame to the connecting heads on the right and left. The connecting heads are then rigidly connected to one another in an easily detachable manner by the seat rod, braced diagonally at the corner points of the main frame. Due to this arrangement, the connecting heads can be regarded as individually freely movable dynamically and vertically on the frame. A wave lifting the boat on one side will raise only one board and thus will raise the vehicle less on the whole.

The diagonal bracing is preferably provided by intersecting cables. As an alternative or in addition to this, the diagonal bracing may also be provided by a stronger rectangular fabric. This fabric can then also serve as the seating surface.

It is advantageous if the flexible elements are elastic. Although the bracing and the arrangement of the flexible connecting pieces ensure a certain elasticity of the frame, it is advantageous if the flexible elements are designed to be elastic.

Transport of the water vehicle is greatly simplified if the frame can be divided in the area of the flexible elements, The division of the frame in the area of the flexible elements results in two rigid frame parts which are to be connected fixedly together by inserting the flexible elements and the diagonal bracing.

An advantageous embodiment of the water vehicle according to this invention provides for the frame to be connected to the surfboards in an easily detachable manner by a mast base receptacle and foot loops on the surfboards. This makes it possible to use surfboards manufactured by standard methods, which can be used further as a water vehicle according to this invention and also as surfboards without any great redesign measures.

Excellent driving properties are obtained when the water vehicle has a manually operated device for controlling the direction of movement by means of which the surfboards are hinge-connected opposite the direction control by means of the foot loops on them over the support elements which are attached there in an easily detachable manner and are pivotably mounted on the frame. The swiveling of the surfboards when turning corners makes it possible to turn much tighter curves, because the surfboards assume the function of a keel or leeboard.

It is advantageous if the frame has control devices. For example, devices for changing the direction of travel, gear controls or speed control devices may be provided on the frame. A steering device is preferably mounted on a frame spar connecting the surfboards, while the gear transforming and speed control devices are arranged on the legs of the frame arranged in the direction of travel.

In addition, fastening devices are provided on the frame. These fastening devices may serve different purposes, such as securing luggage containers, reserve gas tanks or the like.

The fastening devices may also serve to mount a sail on the water vehicle. Preferably at least one mast base mount, which is known in the sport of surfing, is attached to the frame for mounting one or more sails on the water vehicle. In addition, however, a stationary mast may also be attached to the frame and anchored there.

It is especially advantageous if the frame has devices for attaching leeboards. These leeboards are preferably the fins known from the area of surfing, and they should be arranged approximately in the middle of the frame.

At high speeds in particular, it is advantageous if the forward frame part in the direction of travel haa a spoiler. Such a spoiler ensures that when traveling at speed more than 50 km/h, for example, the bow of the water vehicle will be forced down. Directional stability at high speeds can also be supported by upright guide fins projecting into the air.

A simple, stable frame structure is achieved by the fact that the legs of the frame arranged in the direction of travel are connected with a cable on opposite ends, preferably at the rear ends in the direction of travel. Just attaching a cable in the rear area additionally ensures that a motor mounted on the frame will be protected.

BRIEF DESCRIPTION OF THE DRAWING

One embodiment of a water vehicle according to this invention is illustrated in the figures and described in greater detail below; with reference to the drawing, in which.

DETAILED DESCRIPTION OF PREFERRED EMBODIMENTS

Figure 1:
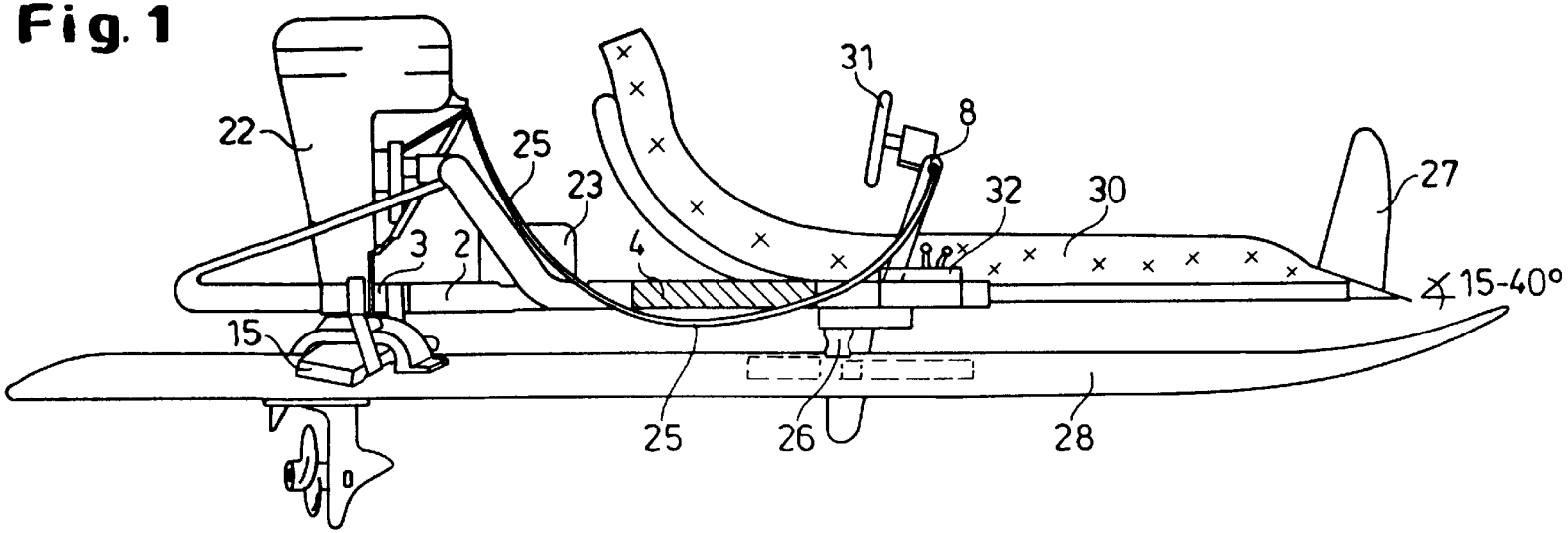
FIG. 1 is a side view of the water vehicle according to this invention.
Figure 2:
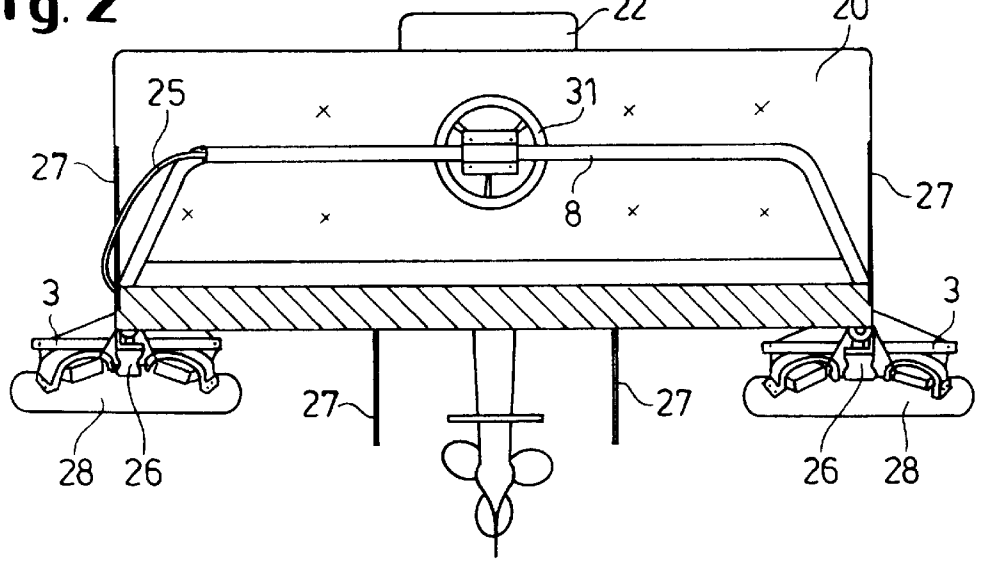
FIG. 2 a front view of the water vehicle according to FIG. 1.
Figure 3:
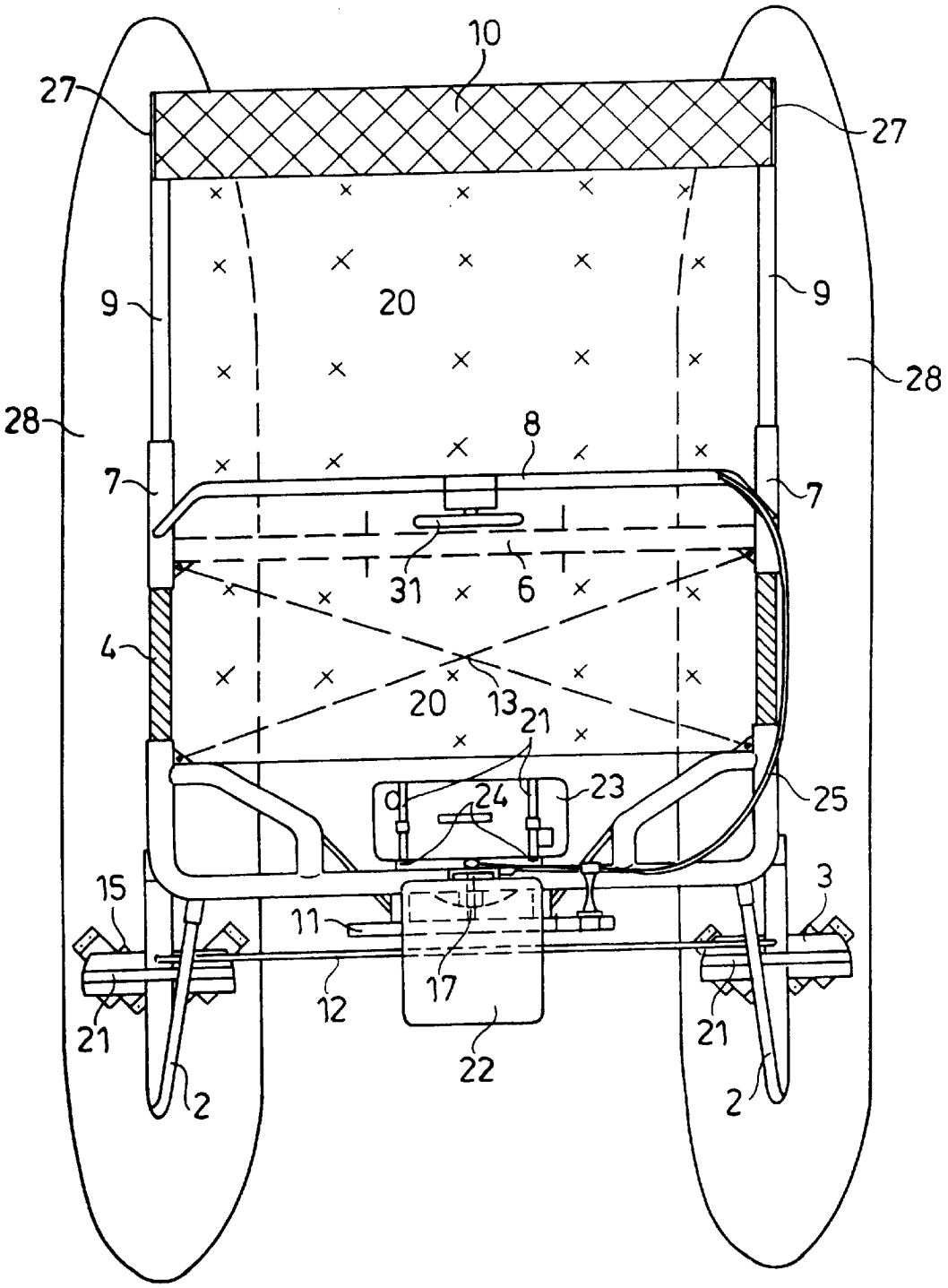
FIG. 3 is a top view of the water vehicle according to this invention.

The surf glider illustrated in FIGS. 1 through 3 has two parallel surfboards 28 arranged with a distance between them, connected to one another with the help of a frame, so they can move vertically independently of one another in a dynamic manner. The front spoiler 10 attached at the forward end is inserted movably at an angle of 15° to 40° into the rigid forward elements 9 which are in turn inserted into the frame heads (connecting heads) 7. These are connected to one another rigidly at the sides by seat rod 6 and have a silit connection 26 to the surfboard 28 at the bottom and, toward the rear, a receptacle for a torsion connecting element 4 which is inserted at another end into the rear main frame 1. The frame heads 7 are rigidly connected to one another by the connecting rod 6, which serves as a seat, and a steering frame 8 and are held together under tension by seat cloth 20, which is placed over the forward elements 9 and attached to the connecting frame 5. The rear frame 1 is braced diagonally with frame heads 7 by means of steel cables 13, thus keeping the rectangle statically stable, because the rear frame 1 is statically rigid. Auxiliary frames 2 are inserted into this frame toward the rear, with supports 3 resting on them, and are attached to the foot loops of the surfboard 28 by tension tamps 21 and foot loop inserts 15 in a slip-proof, readily detachable manner. The rotatable supports 3 are connected by a connecting rod 12 by means of which the steering force is deflected uniformly to the surfboard 28 in the direction opposite the steering movement of the motor 22 to support turning by means of a reversing lever 17. The motor 22 is bolted to the motor level 11 in the traditional manner. An outboard motor 22 whose steering connection is movably attached to the reversing lever 17 and the steering force transmission 25 is mounted on motor level 11 by a traditional technique.

A tank mount 24 which secures a tank 23 can be detachably mounted on the main frame 1 by means of tension tamps 21 in front of the motor 22.

The steering wheel 31 is arranged on the steering frame 8, and a steering force transmission 25 which relays the steering force to the reversing lever 17 on the motor 22 is attached to its mount.

Figure 4:
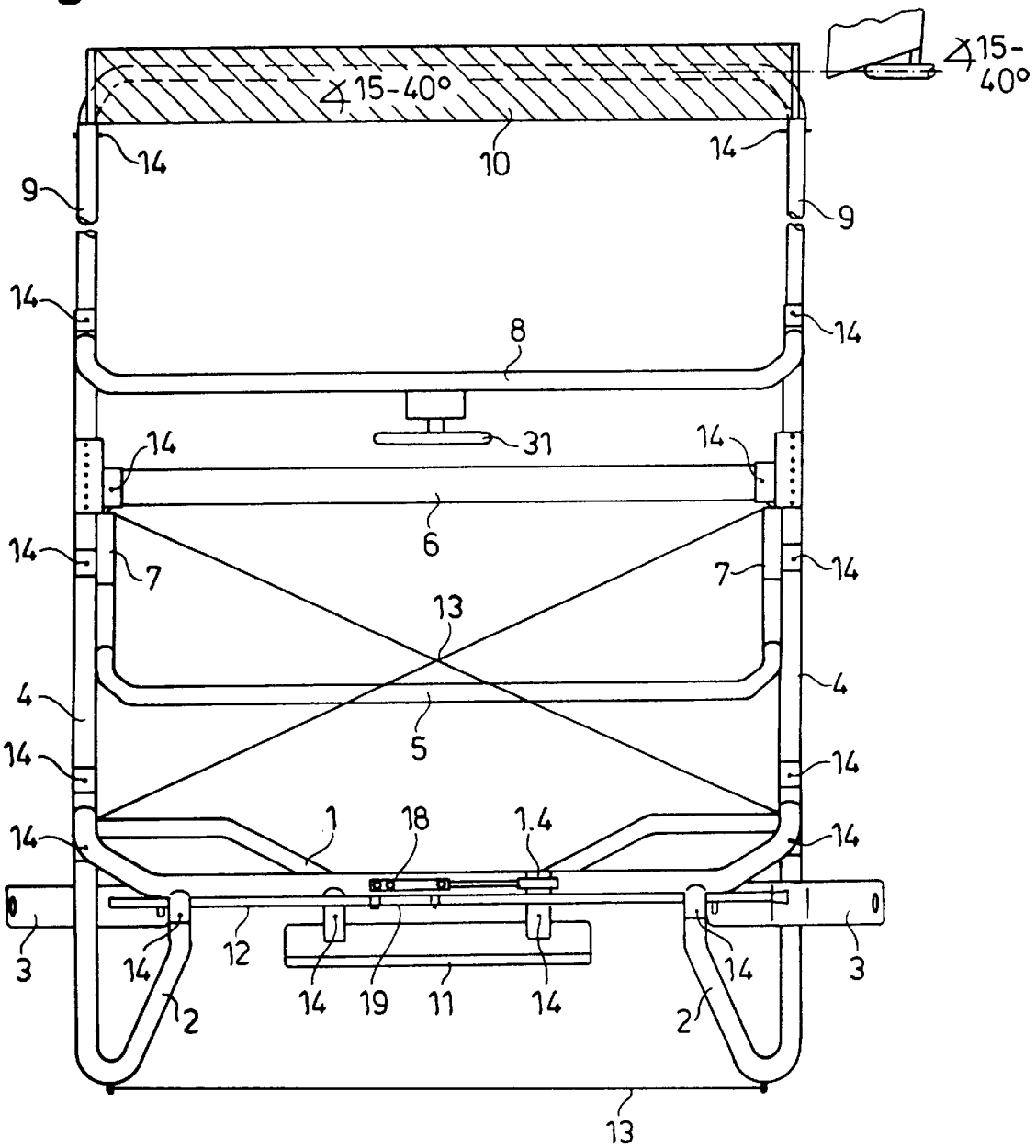
FIG. 4 is a top view of the frame of the water vehicle.

FIG. 4 shows the water vehicle without surfboards 28, motor 22, seat 30 as well as support 3 and tank 24. The top view shows a frame capable of twisting. Therefore, the steel cables 13 hold the rectangle so it is statically stable with a force acting on it. The front spoiler 10 may be mounted at an angle adjustable and is inserted into the front element 9 and secured with locking pins 14. This shows clearly the connecting rod 6, which is inserted into the two frame heads 7 and locked with locking pins 14, holding them together rigidly. In the rear part there is the motor level, which is inclined slightly at an angle on frame 1 and is mounted so it is easily detachable by insertion bushings and locking pins 14. The supports 3 rotate on the rear auxiliary frame 2 and are adjusted either to the left or right uniformly, depending on the position of the reversing lever 17 by means of connecting rod 12 to support the turning of the surfboards. The top part 18 of the reversing lever 17 is connected to the steering, and the bottom part 19 deflects the force to the connecting rod 12. The mount for tiller arm 16, connecting the steering device to the motor 22, is also in the top part 18. The steering force is traditionally guided by steering wheel 31 to connection 1.1 and deflected by hydraulic means. The rear auxiliary frames 2 are inserted into receptacle bushings provided on the main frame 1 for this purpose and secured with locking pins 14.

In addition, eyes may be provided on the rear end of the auxiliary frames, so a tension cable 13 can be suspended in the eyes to support the end points under high load.

Figure 5:
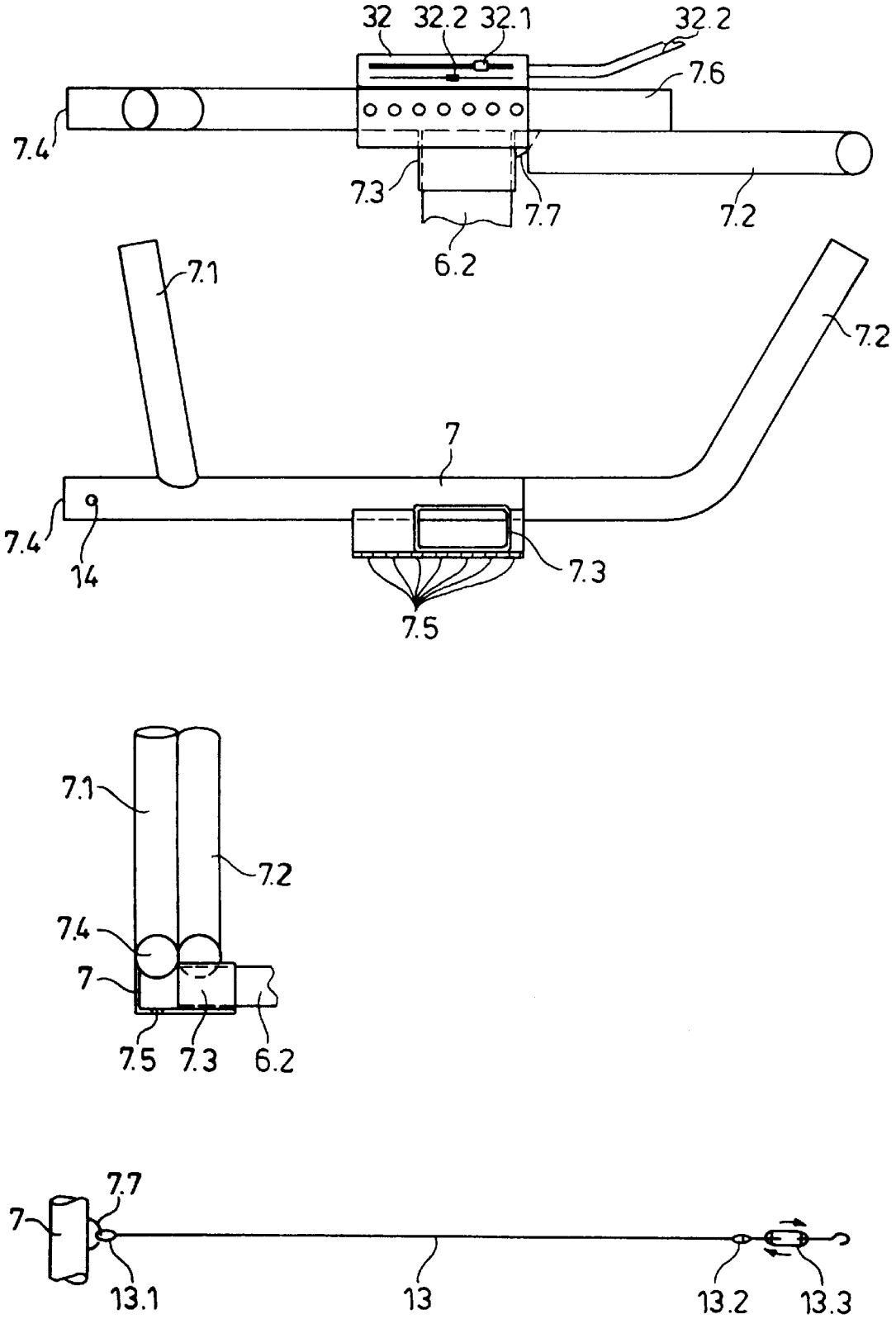
FIG. 5 are various enlarged details of the left frame head in the direction of travel.
Figure 6:
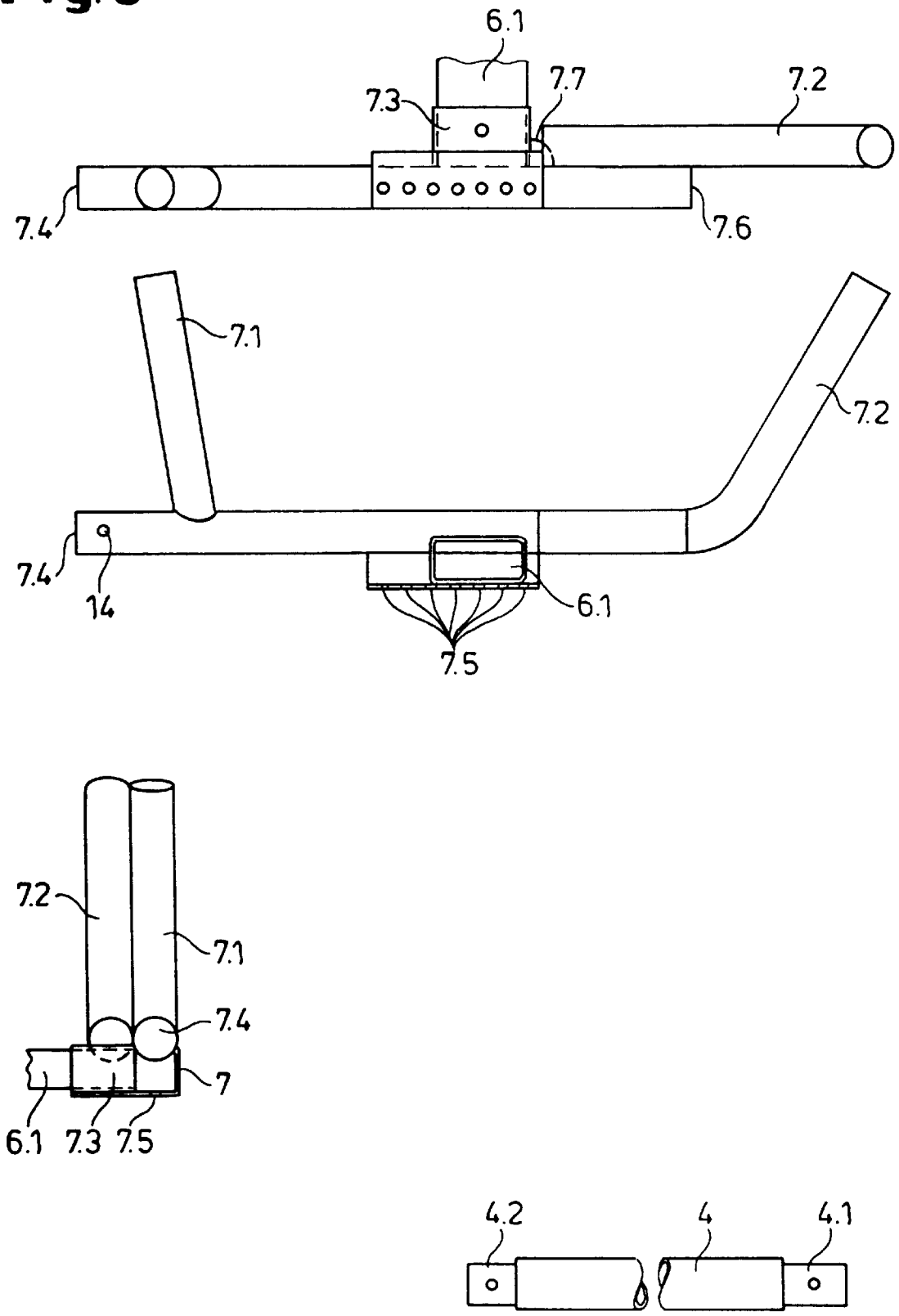
FIG. 6 are various details of the right frame head in the direction of travel.

FIGS. 5 and 6 show two frame heads in three views, designed in mirror image to one another. The front elements 9 are inserted into the orifice 7.4 and secured through the orifice with a locking pin 14. The steering frame is fixedly inserted into 7.1 and likewise secured. Several orifices permitting a flexible mounting of the silit connectors 26 are provided in position 7.5, thus facilitating an adaptation of the frame to different surfboards 28.

In addition, FIG. 6 shows a torsion connecting element 4 which is made of a flexible material and one each of the same design is provided on both sides of the frame. It has a borehole 4.1, which accommodates the locking pin 14 and secures the end after inserting it into the orifice 7.6 on frame head 7. The other end with borehole 4.2 is inserted into orifice 1.4 on main frame 1 and secured with locking pins 14. Seat rod 6 is inserted and secured at point 7.3, and the seat frame is inserted at point 7.5 and secured by pins 14. This frame head 7 is made of a rigid material and should not twist.

FIG. 5 shows a traditional motor control 32 mounted on the starboard side of the water vehicle and offers increased operating convenience at this location, By means of this motor control 22, the motor 22 can be regulated easily for gears with a gas pedal 32.2 and another lever 32.1.

In addition, FIG. 5 shows a tension cable 13 whose end 13.1 is an eye which is latched securely at retaining point 7.5. The other end 13.2 of the tension cable is likewise provided with a fixed eye which is fixedly latched to a variable tension roller 13.3. This variable tension roller 13.3 is suspended at mounting point 1.7 and is rotated under tension in the completely assembled frame on the rear main frame 1 so that the middle of the cable can be moved by a maximum of 3 cm.

Figure 7:
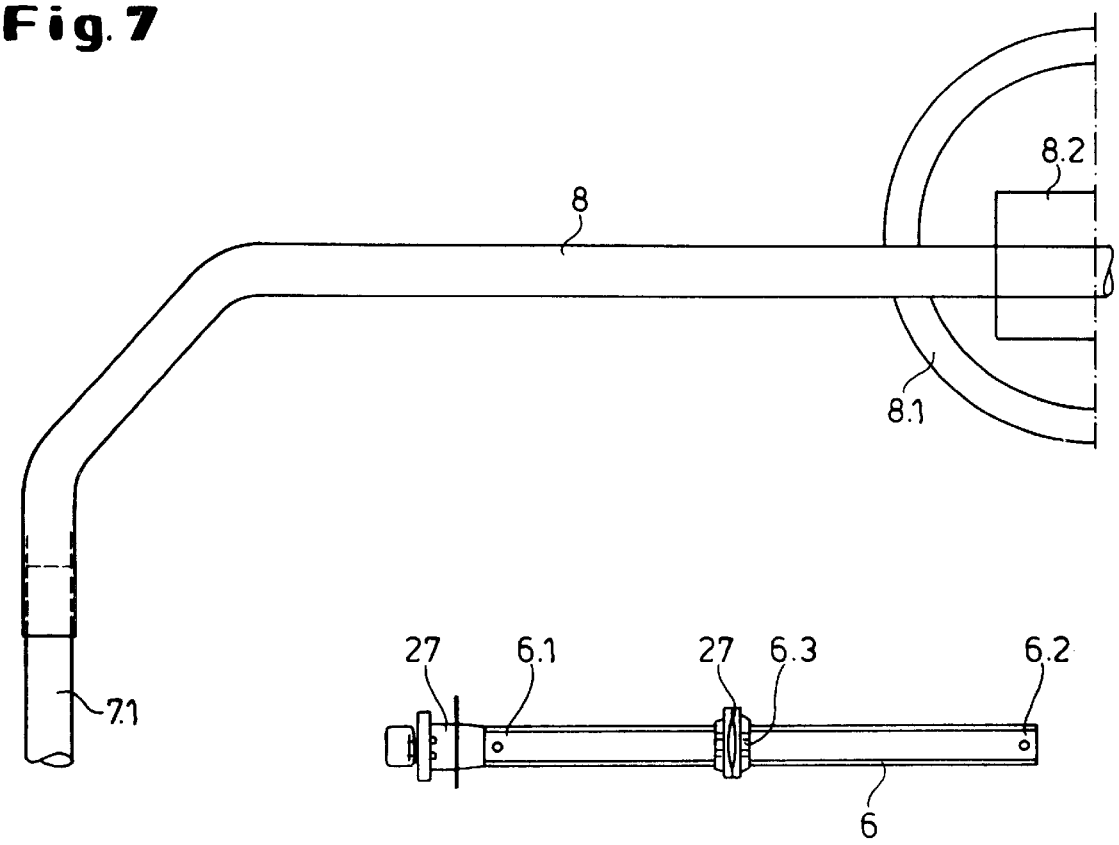
FIG. 7 is an enlarged detail of the steering frame and an illustration of a seat bar.

FIG. 7 shows a steering frame 8 with steering wheel 8.1 and a seat rod 6. At 8.2 the steering force is converted to hydraulic force, for example, so that the steering force can be relayed to the motor 22.

The seat rod 6 has a mount 6.3 screwed on it for traditional surf fins 27, which serve to stabilize the boat in turning.

Figure 8:
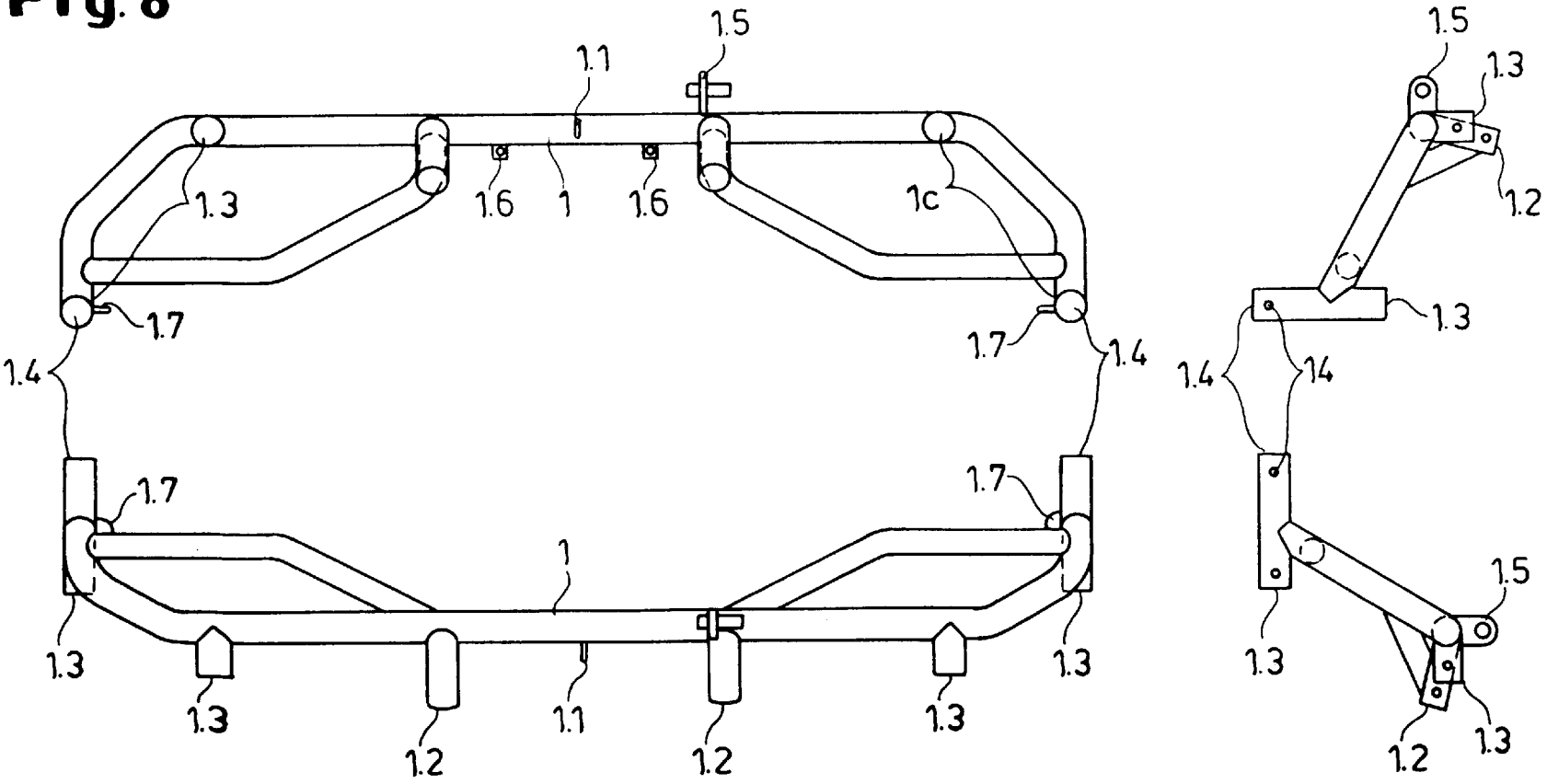
FIG. 8 are various details of a rear frame in the direction of travel with a deflection device.

FIG. 8 shows three views of a main frame 1 from which everything detachable has been removed. In transport, it is the largest single component of the dismantled frame. It is statically rigid and relays the driving forces of the motor especially well. The torsion connecting elements are inserted at points 1.4. The rear auxiliary frames are inserted at 1.3 and secured there. The reversing lever 17 which is secured with a splint rotates on 1.1. a mount 1.5 is provided for a commercial conversion. A tank mount can be connected at 1.6 with bolts. The mounts 1.7 are provided for the tension parts.

Figure 9:
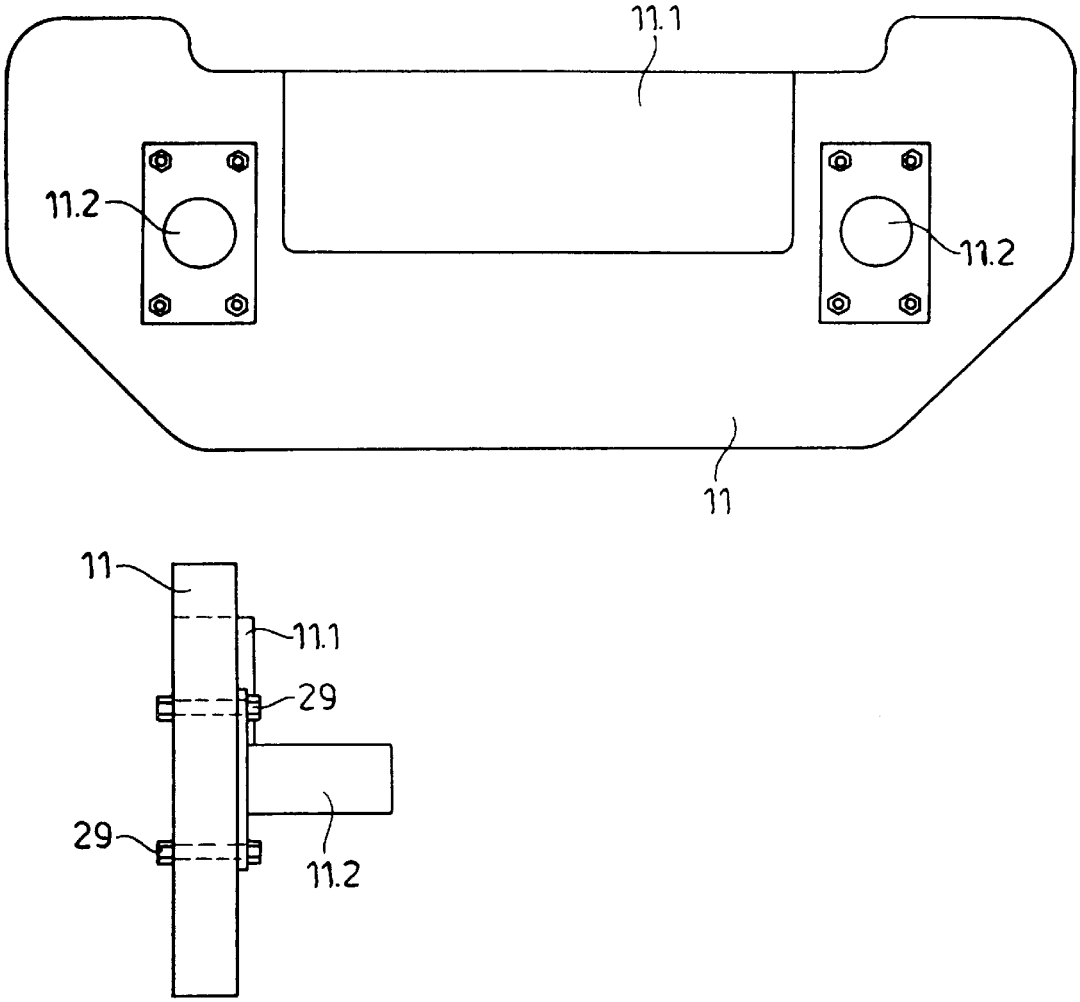
FIG. 9 are two views of the motor level.

FIG. 9 shows two views of a motor level 11 with insertion bushings 1.2 mounted on it with bolts. A safety plate 11.1 made of aluminum protects the motor level 11 made of wood from the retaining screws of the motor 22.

Figure 10:
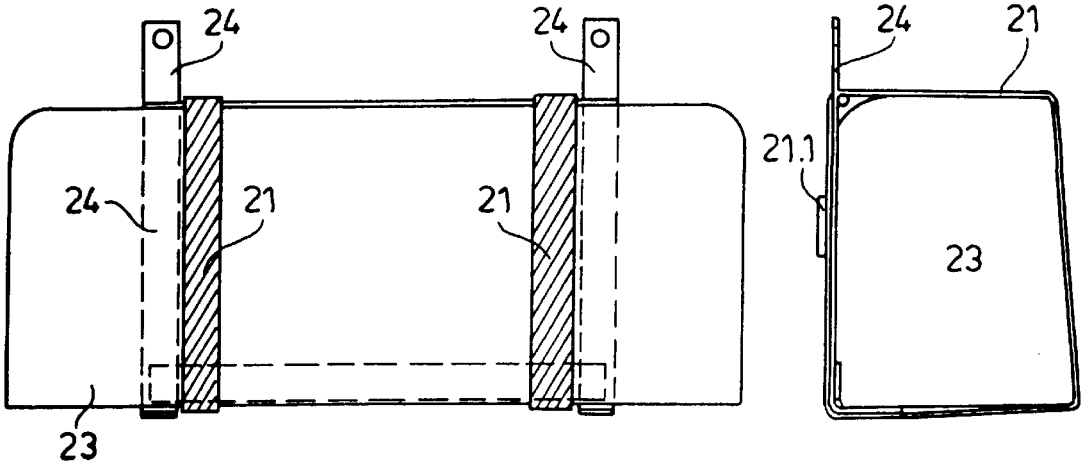
FIG. 10 are two views of a tank mounting device.

FIG. 10 shows a retaining device 24 for a tank which is mounted constantly with bolts on mounts 1.6 provided for that purpose on the main frame 1. Tank 23 is secured on the mount with tension belts or tension tamps 21 so that it is easily detachable. A toggle-type closure 21.1 is provided for tension tamp.

Figure 11:
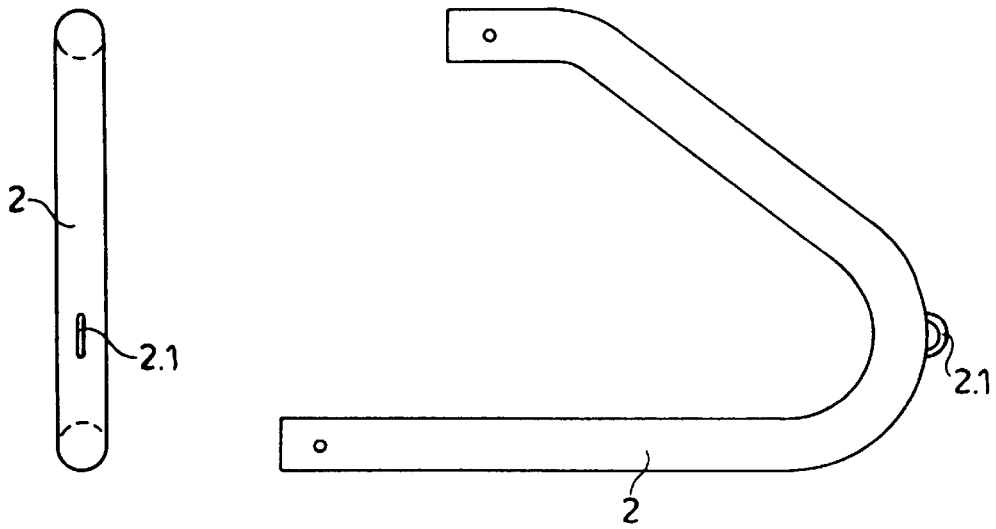
FIG. 11 are two views of one detail of the rear frame part in the direction of travel.

FIG. 11 shows two views of a rear auxiliary frame 2 for the supports 3. This auxiliary frame is provided in duplicate in mirror image and serves as the axis of rotation for the supports 3.

Figure 12:
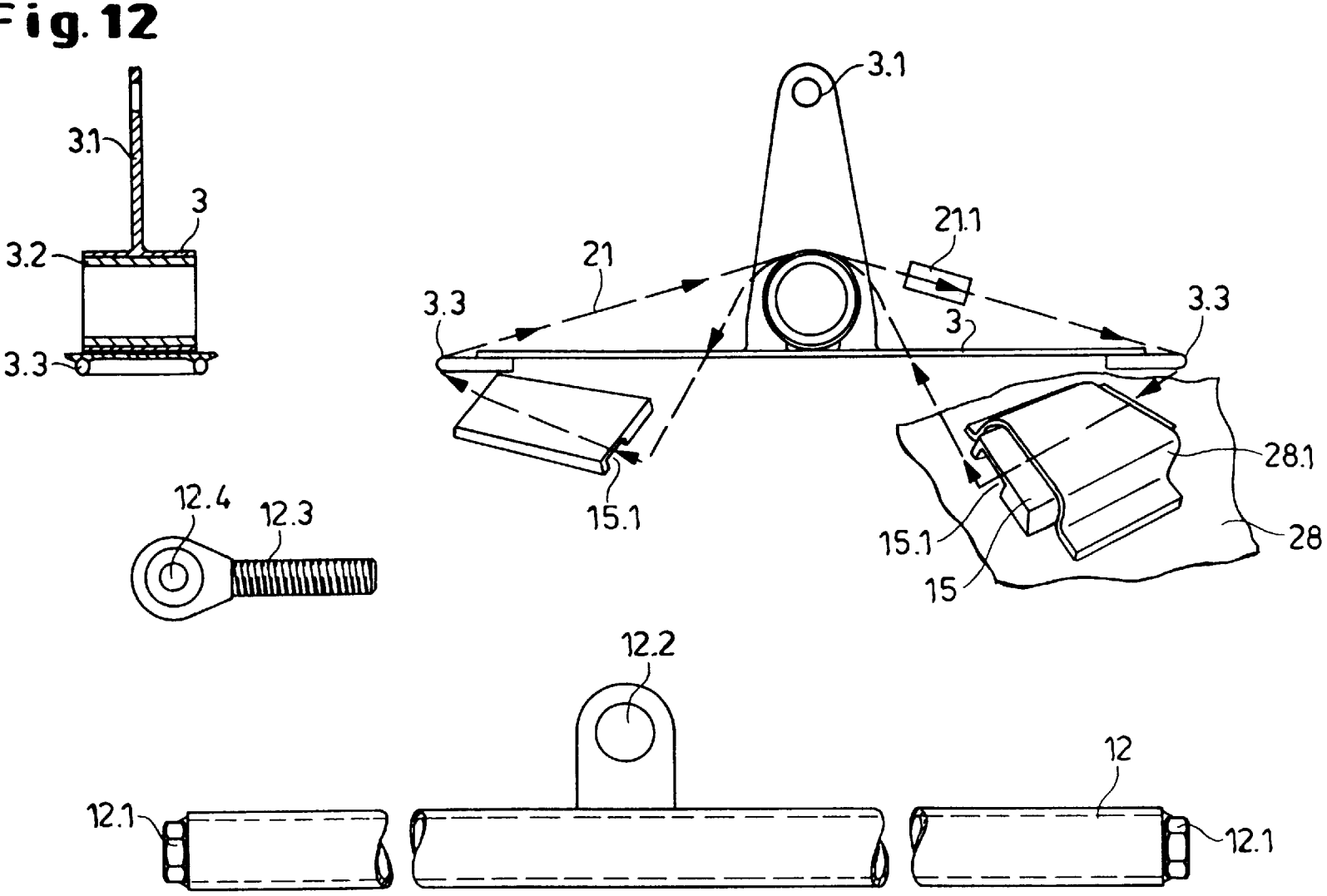
FIG. 12 are various details of a support and a connecting rod.

FIG. 12 shows the support 3 in two views and a connecting rod 12 with foreshortening. Ball head joints 12.3 sit in the end points 12.1 and are screw connected with their head orifice 12.4 to the orifice 3.1 of the supports. The orifice 12.2 is hinge connected by a locked axle to the lower unit 19.3 of the articulated joint 17. The guidance of a tension tamp 21 is shown in the top part of the drawing. The beginning of the tension tamp 21 is inserted through the orifice 3.3 in the support 3 from above and inserted beneath insert 15 into its insertion orifice 15.1. Then the tamp 21 is placed over the tube piece of 3 or 2, and exactly the same procedure is followed with the other foot loop, by passing the tamp 21 through the recess 15.1 on the lower side of the insert and guiding it again through the orifice 3.3 of the support 3 from beneath. Tension belt 21 is then pulled tightly with the closure 21.1 and put under tension so there is no play between surfboard 28 and supports 3. The insertion element 15 should completely fill out the respective foot loop 28.1.

Figure 13:
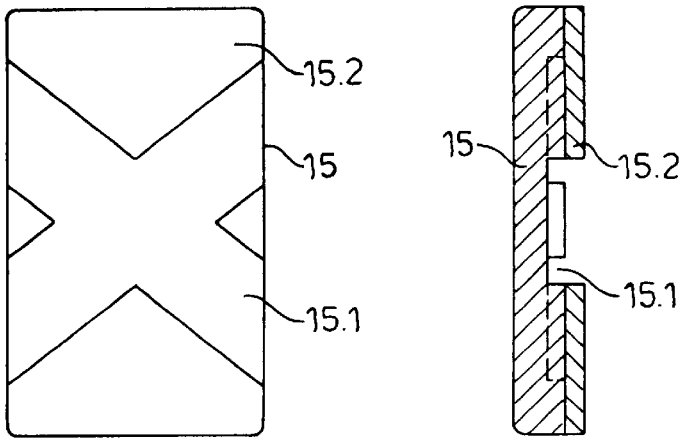
FIG. 13 are two views of an insert element with a strap retainer.

FIG. 13 shows a foot loop insert 15 which is shown in two views. A soft adaptable foam layer 15 is glued to the bottom side and protects the surfboards 28 from damage. The X-shaped recess permits universal usability with right and left foot loops.

Figure 14:
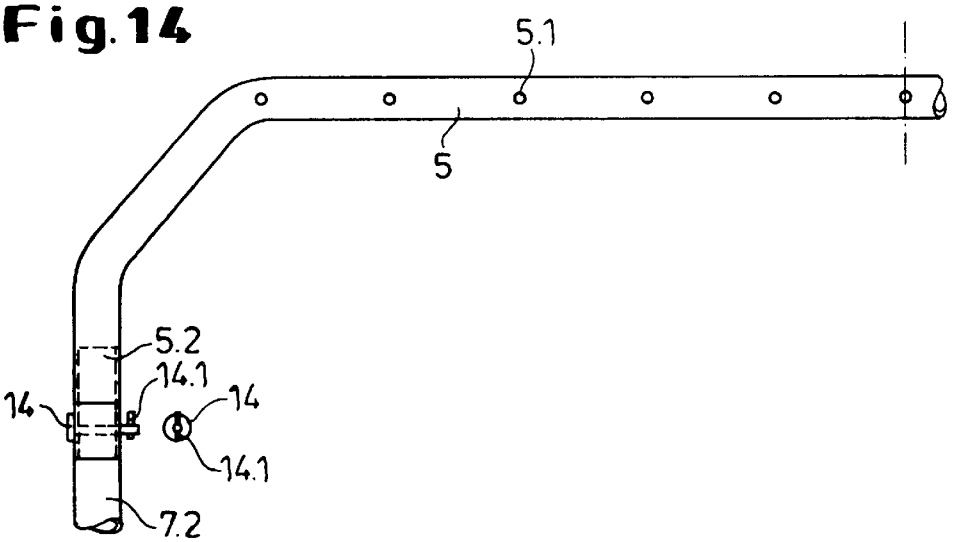
FIG. 14 is a carrier tube for a seat cloth.

FIG. 14 shows a carrying tube 5 for a seat cloth 20 up to its level axis // axle and a locking pin 14. This locking pin 14 is of a traditional design with a head and a shaft at the end of which a lock 14.1 can be folded over. It is shown here in the secured state, because the leg 14.1 is standing perpendicular. To pull out the pin, the leg 14.1 must aligned. The lower ends 5.2 of the frame tube 5 are inserted into the mounts 7.2 provided for them on the frame heads 7 and secured with a locking pin 14. The eyes 5.1 are provided for securing the seat cloth 20.

Figure 15:
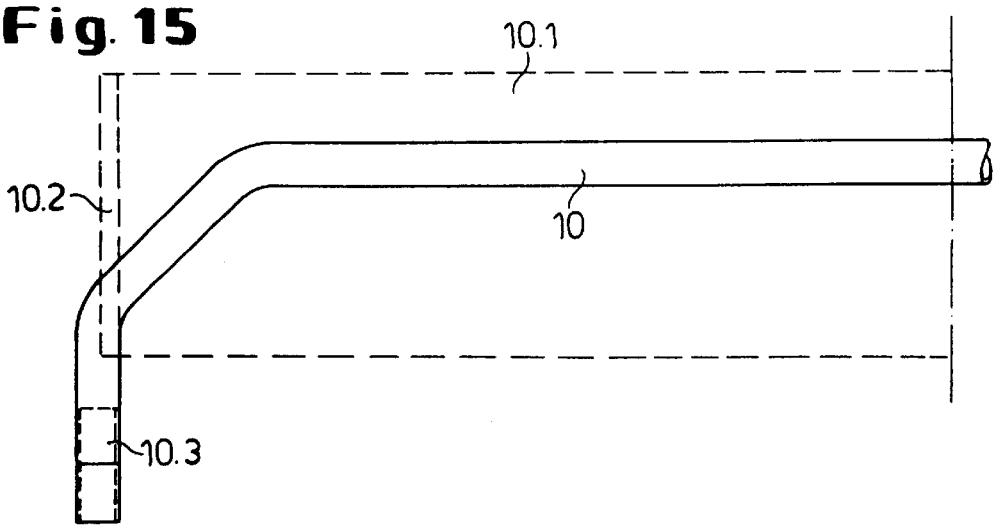
FIG. 15 is a detail of the front frame.

FIG. 15 shows a front frame 10 on which can be mounted a front spoiler set on edge at a slight angle. This prevents rolling of the front side of the entire surf glider when traveling at speeds above 50 km/h. Since it is slightly downward, variably, at the front, it produces abrasion. The ends 10.2 standing at a right angle may be the surf fins normally provided on the surfboard. This front spoiler should be strong enough to stand on, because it is often used for getting on and off the water vehicle.

Figure 16:
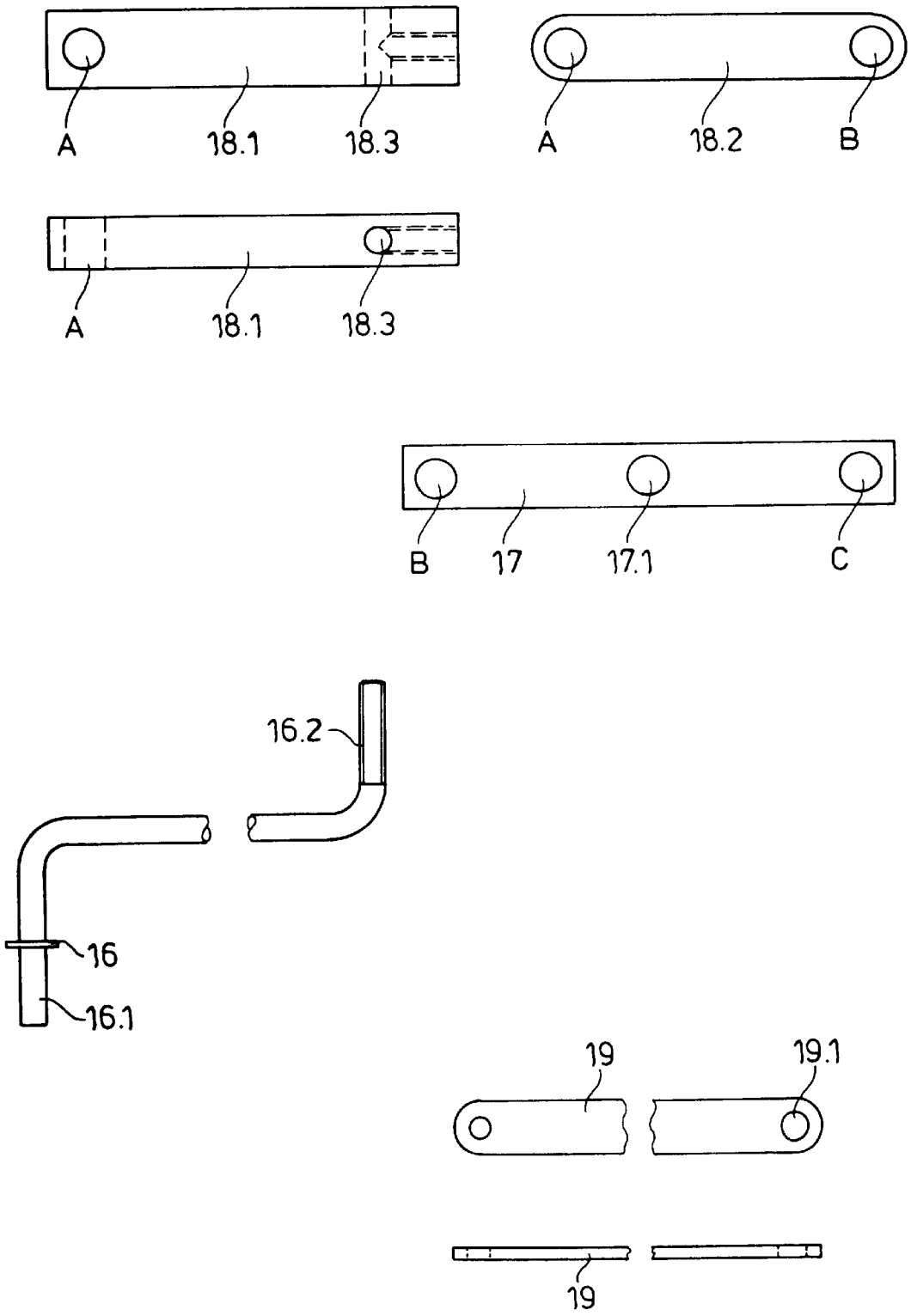
FIG. 16 are individual elements of a deflection device.

FIG. 16 shows the individual components 16 through 19 of the deflecting device. The articulated joint 19 is provided twice and each one is connected by an articulated axle in one point, thus resulting in a scissors-type joint. This transmits the forces with variable distances and changes its angle in the process. The other orifices 19.1 are hinge-connected to the connecting rod 12 at the mounting point 12.1 and at the other end to reversing lever 17 at its orifice C. The orifice 17.1 is placed over pin 1.1 and locked so that reversing lever 17 can rotate on it.

Lever 18.2 is also connected in an articulated manner at its point B on its upper orifice C. Its upper point A is connected to point A of the steering arm end 18.1 in the same articulated manner. The steering arm end is connected to the end of steering force transmission 25 mounted on the main frame 1 and thus directs the steering force to lever 18.2 which further relays the steering motion to reversing lever 17, which reverses it into the opposite direction and relays it to the connecting rod 12 by means of a scissors-type joint 19. The other orifice 18.3 on steering arm end 18.1 accommodates the tiller arm 16, which transmits the steering force and the steering motion to the motor 22.

Thus, when the steering wheel 8 is turned clockwise, the steering force transmission 25 relays to the motor 22 a motion which causes the boat to travel to the right. At the same time, the surfboards 28 are pivoted down on the right and up on the left, as seen in the direction of travel, so that support is provided over the surfboards when turning.

An alternative embodiment which can easily be rigged to yield an embodiment according to this invention by means of flexible elements and a diagonally braced rectangle is known from German Patent No. 4,243,752. The embodiment described there has many identical elements and many similar elements which can also be used with the embodiment described above.

What is claimed is:

1. A water vehicle, comprising:

a frame assembly having a main frame, two spaced-apart parallel frame legs secured to the main frame and pointing in a direction of travel of the water vehicle, and a connecting rod, having opposite ends, for interconnecting the frame legs transversely to the direction of travel at a distance to the main frame, thereby defining a rectangular configuration of the frame assembly, each of said frame legs having incorporated therein a flexible element;

two surfboards, one surfboard secured to one of the frame legs and to one end of the connecting rod, and the other one of the surfboards being secured to the other one of the frame legs and the other end of the connecting rod; and connecting means for diagonally bracing the rectangular frame assembly.

2. The water vehicle of claim 1, wherein each of the flexible elements is of elastic material.

3. The water vehicle of claim 1, wherein the flexible elements are detachably mounted to the frame legs, to thereby permit a dismantling of the frame assembly.

4. The water vehicle of claim 1, and further comprising connection means, including a mast base receptacle and foot loops, for detachably securing the frame assembly to the surfboards.

5. The water vehicle of claim 4, wherein the frame assembly includes an auxiliary frame extending rearwardly from the main frame, and further comprising support elements swingably mounted to the auxiliary frame and detachably secured to the foot loops, and a manually operated device, mounted to the frame legs, for controlling the direction of travel by pivoting the surfboards in opposition to the direction control by means of the foot loops on the surfboards and the support elements attached thereto.

6. The water vehicle of claim 5, wherein the manually operated device includes a steering unit.

7. The water vehicle of claim 1, wherein the frame assembly includes fastening devices.

8. The water vehicle of claim 1, wherein the frame assembly has means for fastening leeboards.

9. The water vehicle of claim 1, wherein the frame assembly includes a front frame extending the frame legs forwardly in the direction of travel, and further comprising a spoiler secured to the front frame.

10. The water vehicle of claim 1, wherein the connecting means includes a cable for bracing opposite ends of the frame legs.

11. The water vehicle of claim 10, wherein the cable extends between opposite rear ends of the frame legs.

* * * * *